United States Patent [19]

Harman

[11] Patent Number: 5,018,455

[45] Date of Patent: May 28, 1991

[54] FEED SYSTEM FOR PELLET BURNING STOVE

[75] Inventor: Dane P. Harman, Halifax, Pa.

[73] Assignee: Harman Stove and Welding, Inc., Halifax, Pa.

[21] Appl. No.: 538,882

[22] Filed: Jun. 15, 1990

[51] Int. Cl.[5] ..... F23K 3/14; F23K 3/16

[52] U.S. Cl. ..... 110/110; 110/109

[58] Field of Search ..... 110/109, 110, 289; 414/158

[56] References Cited

U.S. PATENT DOCUMENTS

| | | | |
|---|---|---|---|
| 910,305 | 1/1909 | Nisbet . | |
| 1,201,664 | 10/1916 | Williams . | |
| 2,143,834 | 1/1939 | Mosshart | 110/44 |
| 4,762,073 | 8/1988 | Giaier et al. | 110/109 X |
| 4,779,544 | 10/1988 | Stevens | 110/110 |
| 4,787,322 | 11/1988 | Whitfield | 110/266 |
| 4,803,973 | 2/1989 | Harman | 126/73 |
| 4,922,889 | 5/1990 | Nuesmeyer et al. | 126/73 |

FOREIGN PATENT DOCUMENTS 514559 11/1939 United Kingdom .

*Primary Examiner*—Edward G. Favors
*Attorney, Agent, or Firm*—Thomas Hooker

[57] ABSTRACT

An improved fuel feed system for a solid particulate fueled stove includes a hopper which supplies fuel to an elevated fuel plate. A pusher block forces fuel pellets from the fuel plate through a drop area and into a trough. The drop area is of sufficient distance to prevent burnback.

10 Claims, 3 Drawing Sheets

FIG. 3
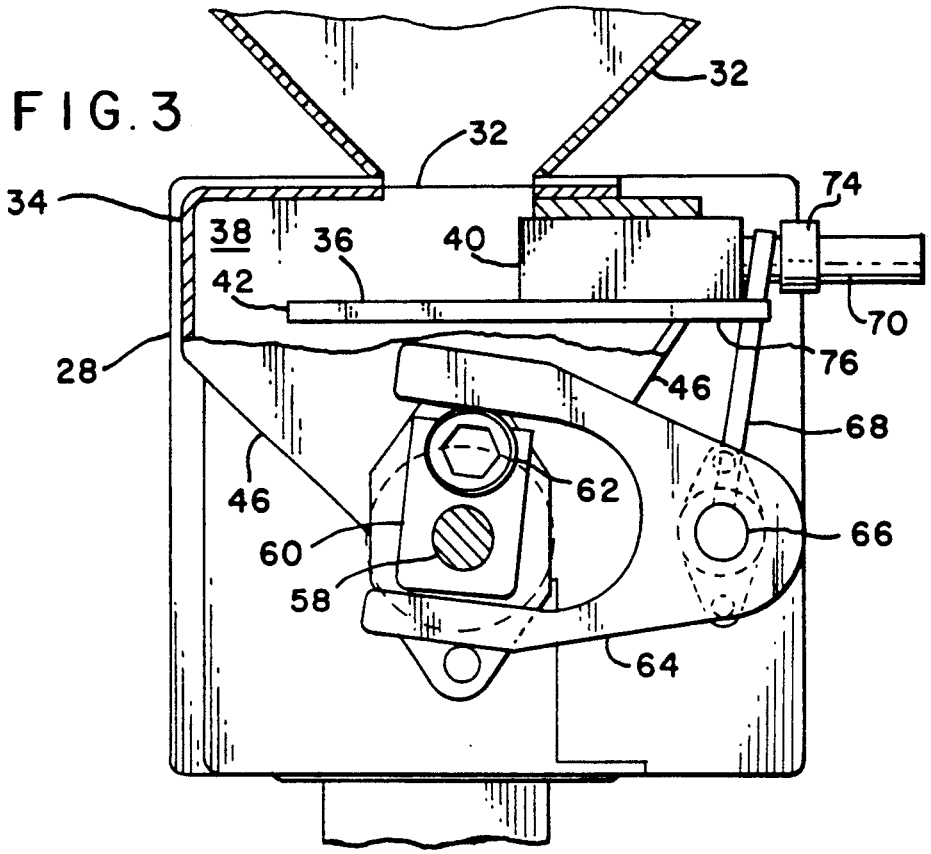
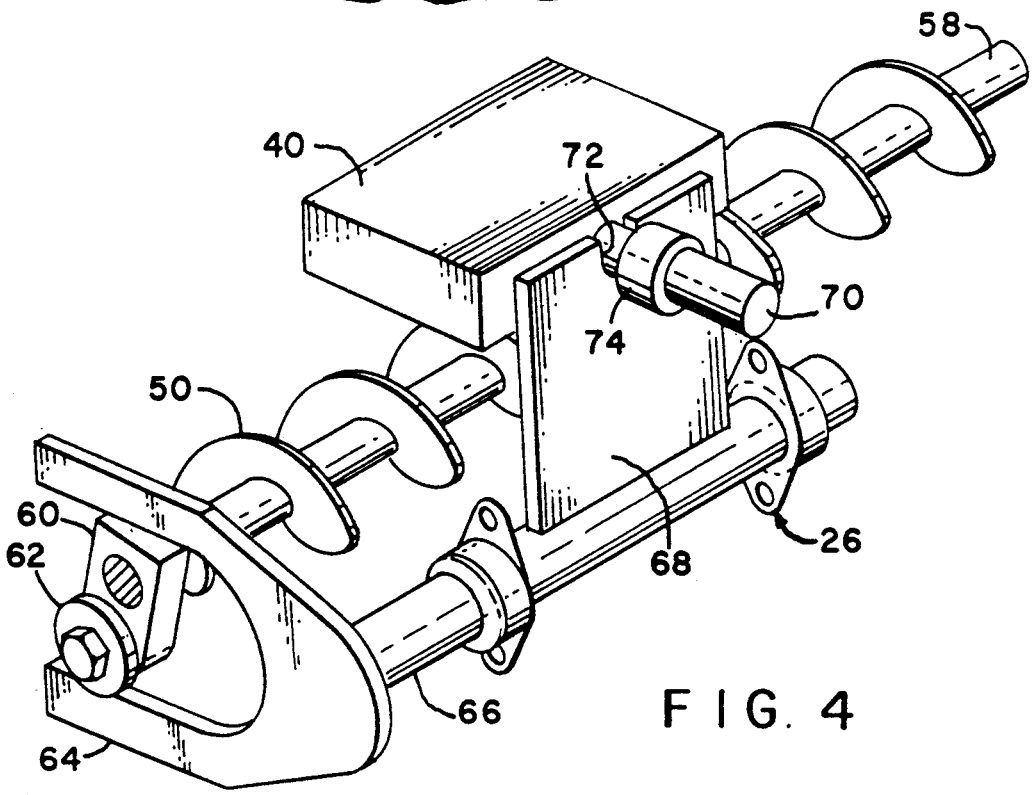
FIG. 4

FEED SYSTEM FOR PELLET BURNING STOVE

FIELD OF THE INVENTION

This invention relates to an automatic feeding mechanism for stoves which burn wood chips, pellets or other similar particulate fuel.

BACKGROUND OF THE INVENTION

The prior art includes stoves with feed systems for metering particulate fuel from a hopper to a firebox. These systems include reciprocal pushers, rotating cups and augers for moving the fuel.

The fuel feed system in a particulate fuel fired stove must prevent burnback, which is the combustion of fuel backwards from the firebox and into the hopper. Burnback is commonly caused when the forced air draft is turned off and burning fuel induces a draft through the hopper and feed system. This draft supplies oxygen to support burnback. The problem is particularly acute with a readily combustible fuel such as wood chips or pellets, walnut shells, peach pits or shelled corn.

Conventional fuel systems prevent burnback in coal fired stoves. These systems include hoppers with oscillating gates, intermittent feed augers and fuel conveyors with burnback barriers. Such systems are relatively complicated and expensive and unsuited for smaller stoves burning highly combustible fuels.

While double auger and rotating cup feeders have been used for wood pellet stoves and are acceptable, they involve extra expense and extra moving parts. The feed rate of rotating cup feeders is difficult to adjust as it requires replacing or removing one or more of the cups.

SUMMARY OF THE INVENTION

The present invention is an automatic feed system for supplying particulate fuel from a hopper to a stove firebox. The feed system features a drop separation space between the reciprocating feed pusher block under the hopper and an auger which transfers fuel from a catch trough to the firebox. This separation isolates the hopper fuel supply from the fire in the stove to prevent burnback into the hopper while reducing the complexity and number of moving parts used.

The feed system may be used in a stove having a fan for supplying a forced draft to the burning fuel. The fan is turned off to turn down the stove. When this occurs the combustible fuel may burn back to the fuel in the auger but is incapable of burning back into the main fuel supply in the hopper located above the auger.

The invention also provides an economical feed system through the use of a common drive to power both the pusher block and the feed auger.

Other objects and features of the invention will become apparent as the description proceeds, especially when taken in conjunction with the accompanying drawings illustrating the invention.

DESCRIPTION OF THE DRAWINGS

FIG. 3 is a sectional view taken along line 3—3 of FIG. 1; and

FIG. 4 is a partial isometric view of the fuel feed system.

DESCRIPTION OF THE PREFERRED EMBODIMENTS

Figure 1:
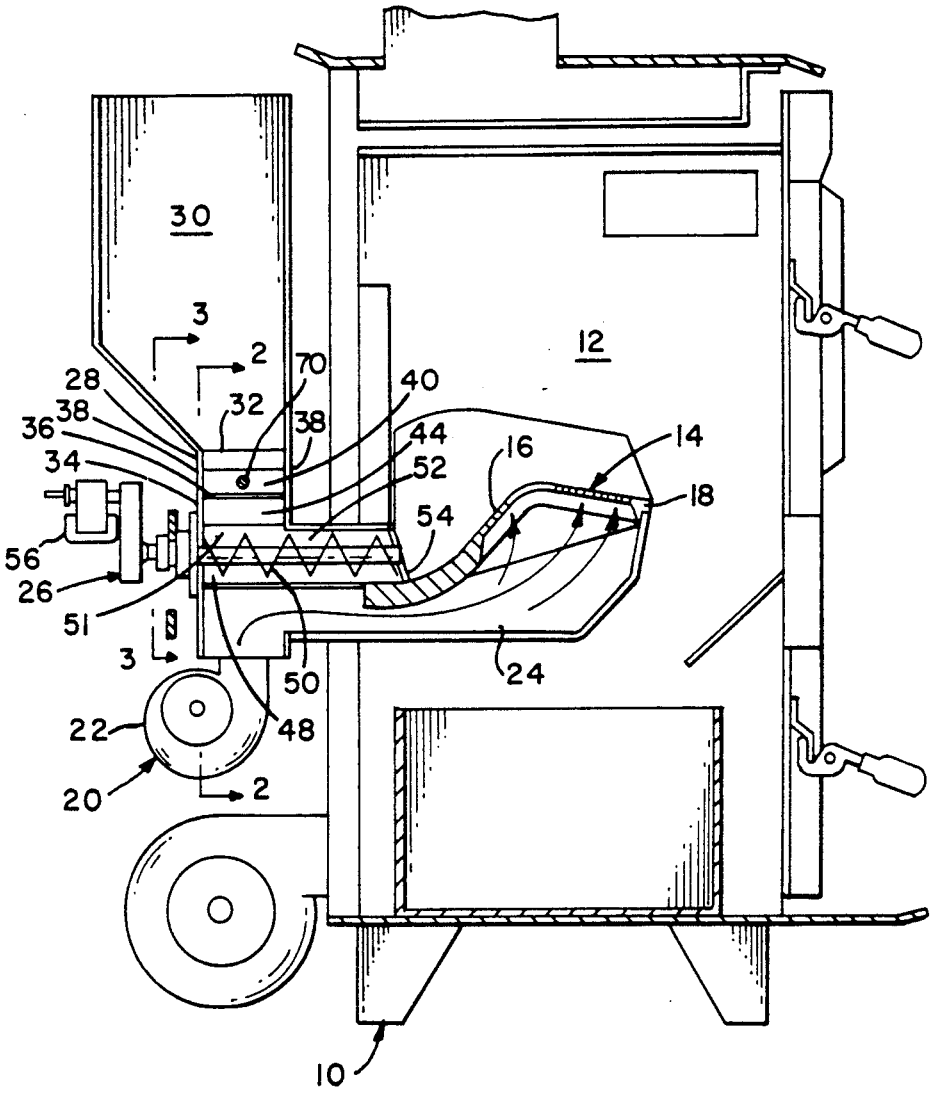
FIG. 1 is a generalized vertical sectional view through a stove with the feed mechanism according to the invention.
Figure 2:
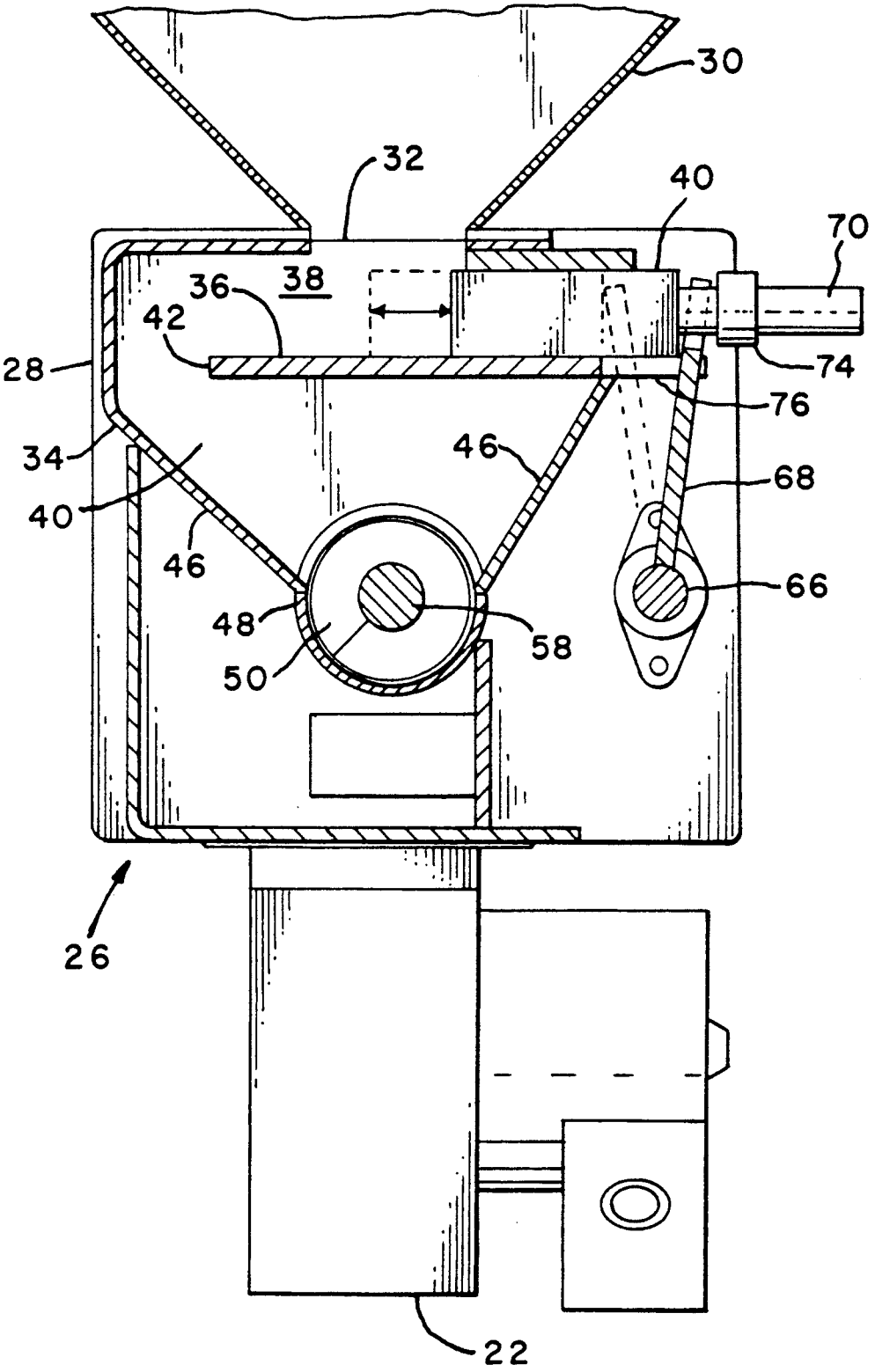
FIG. 2 is a sectional view of the stove feed mechanism taken along line 2—2 of FIG. 1.

Heating stove 10 includes a firebox 12 enclosing a grate 14 having a rise surface 16 and an ash discharge lip 18 as described per my prior U.S. Pat. No. 4,803,973. Combustion air is provided by combustion air system 20 having a blower 22 and an enclosed air flow passage 24. The combustion air blower forces air through the air passage and directly to the grate where it supports combustion by flowing through holes in the grate.

Fuel feed system 26 is mounted on the back of stove 10 and includes a frame 28 supporting a fuel hopper 30 having a mouth 32 opening into an enclosure 34. A horizontal fuel plate 36 is located below the mouth and within the enclosure. The fuel plate extends between vertical enclosure sidewalls 38. A pusher block 40 between the vertical sidewalls 38 rests on plate 36. The block moves reciprocally across the plate. The forward stroke of the pusher block is in the direction of the plate discharge edge 42. Trough 48 is located below the discharge edge. Drop separation 44 between the plate and the bottom of the trough is sufficiently great to prevent burnback between the trough and the plate. Auger 50 extends from the infeed end 51 in the base of the trough through a feed passage 52 and into the firebox via the delivery end 54.

The fuel feed system 26 includes a drive motor 56 attached to shaft 58 of auger 50. Auger shaft carries a radial cam arm 60 with a cam roller 62 at the outer end of the arm. The path of revolution of the cam roller about the auger shaft enables it to engage the arms of the cam follower fork 64. The cam follower fork is mounted on and oscillates a rock shaft 66 in response to rotation of the auger shaft. Flat pusher arm 68 extends radially out from the rock shaft to engage reciprocating pusher block 40. Pusher block adjustment rod 70 extends from pusher block through pusher arm slot 72. Stroke adjustment collar 74 is movably mounted on rod 70. Pusher plate fits between fuel plate extensions 76 which support pusher block on its rearward stroke.

During operation of the stove, fuel pellets are gravity fed from hopper 30 to fuel plate 36 Side walls 38 confine fuel on the plate surface. The motion of the reciprocating pusher block 40 forces fuel off the discharge edge 42. As the fuel falls through the drop separation 44, sloping partitions 46 funnel the fuel into the base of the trough 48 where it flows into the infeed end 51 of the feed passage 52.

Motor 56 drives auger to transport fuel through the feed passage 52 and out the delivery end 54 into the firebox 12. The feed passage provides additional physical isolation of the fuel supply from the combustion area to discourage burnback.

Rotating auger shaft 58 turns attached cam arm 60 and cam roller 62. The roller engages the tines of the cam follower fork 64 and oscillates the fork and the rock shaft 66.

Pusher block rod 70 extends through pusher arm slot 72. The pusher arm is confined between pusher block and stroke adjustment collar 74. Rotary motion of the rock shaft causes the flat pusher arm 68 to reciprocate, engaging alternately the pusher block 40 and the stroke adjustment collar 74, causing pusher block to travel back and forth on fuel plate 36. Pusher block motion is transverse relative to the axis of the auger shaft 58. Fuel plate extensions 76 support pusher block when pusher block is in the portion of its stroke away from the feed plate discharge edge.

The stroke of the pusher block is varied by adjusting the position of collar 74 on the rod 70. The amount of fuel fed from the table to the trough is metered by adjusting the stroke of the pusher block. This allows for a variation in the heat output of the stove.

While the fuel system 26 is intended primarily for use with wood pellets, it also can be used with other particulate fuels such as wood chips, walnut shells, peach pits, corn and the like.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as may invention is:

1. A fuel feed system for conveying particulate fuel such as wood pellets, crushed coal, wood chips and the like from a hopper to a firebox, the system including a hopper having a discharge mouth, a fuel collection plate located below the mouth of the hopper, a pusher block on the fuel collection plate, a fuel delivery passage located below the plate, said passage including a fuel delivery end located in a firebox and a fuel infeed end below the plate, fuel delivery means for moving fuel through the passage from the infeed end to the delivery end, said plate including a fuel discharge edge located on one side of the fuel passage, a fuel collection trough having an upper end surrounding said edge of the plate and a lower end adjacent the infeed end of the fuel feed passage, and drive means for actuating said fuel delivery means and for reciprocating said pusher block, said plate being located a sufficient distance above the trough to prevent burnback of fuel into the hopper.

2. A fuel feed system as in claim 1 wherein said drive means comprises a single motor.

3. A fuel feel system as in claim 2 wherein said fuel delivery means comprises a rotary auger having a central shaft, and including a first drive connection between the motor and the shaft and a second drive connection between the motor and the pusher block.

4. A fuel feed system as in claim 3 wherein said second drive connection includes a rock shaft located on the other side of the fuel passage away from the discharge edge of the plate, a cam and follower connection joining the rock shaft to the auger shaft for rotating the rock shaft back and forth in response to rotation of the auger shaft, a radial arm on the rock shaft extending upwardly to the pusher block and a block connection joining the arm to the pusher block for reciprocal motion of the block in response to the rotation of the auger shaft.

5. A fuel feed system as in claim 4 wherein said block connection includes adjustment means for varying the stroke of the block independently of the movement of the arm.

6. A fuel feed system as in claim 4 wherein said cam and follower connection includes a radial arm on the auger shaft, a cam member on the of the radial arm and a forked follower arm on the rock shaft, the forked arm including a pair of tines, said cam member being located between the tines.

7. A fuel feed system for conveying particulate fuel such as wood pellets, crushed coal, wood chips and the like from a hopper to a firebox, the system including a hopper having a discharge mouth, a fuel collection plate located below the mouth of the hopper so that fuel is gravity fed onto the fuel collection plate, said plate having sidewalls and a discharge edge, a fuel collection trough located beneath the discharge edge, a fuel passage extending from the bottom of the trough to the firebox of a stove, a fuel feed auger in the passage for moving fuel in the passage from the trough to the firebox, the auger including a central shaft, a pusher block on the plate, drive means comprising a single motor and including a first drive connection between the motor and the shaft and a second drive connection between the motor and the pusher block for moving fuel from the collection plate via the discharge edge to the collection trough.

8. A fuel feed system as in claim 7 wherein the second drive connection includes a rock shaft, a cam and follower connection joining the rock shaft to the central shaft for oscillating the rock shaft in response to rotation of the central shaft, a radial arm on the rock shaft extending to the pusher block, and a connection joining the radial arm to the pusher block for reciprocal motion of the block in response to the rotation of the central shaft.

9. A fuel feed system as in claim 1 wherein said fuel collection plate is essentially horizontal.

10. A fuel feed system as in claim 7 wherein said fuel collection plate is essentially horizontal.

* * * * *